United States Patent [19]

Ellis et al.

[11] Patent Number: 5,045,839

[45] Date of Patent: Sep. 3, 1991

[54] PERSONNEL MONITORING MAN-DOWN ALARM AND LOCATION SYSTEM

[75] Inventors: Rand G. Ellis; Richard L. Abrahams, both of Lauderhill; James M. Rosenthal, Cooper City, all of Fla.

[73] Assignee: Rand G. Ellis, Fla.

[21] Appl. No.: 490,334

[22] Filed: Mar. 8, 1990

[51] Int. Cl.[5] ..... G08B 1/08; G08B 13/14

[52] U.S. Cl. ..... 340/539; 340/531; 340/573; 340/309.15; 340/689; 340/693

[58] Field of Search ..... 340/539, 531, 573, 566, 340/572, 686, 689, 693, 309.15

[56] References Cited

U.S. PATENT DOCUMENTS

| | | | |
|---|---|---|---|
| 3,163,856 | 12/1964 | Kirby | 340/539 |
| 3,579,221 | 5/1971 | Ashley | 340/539 |
| 3,588,858 | 6/1971 | Demuth | 340/539 |
| 4,110,741 | 8/1978 | Hubert et al. | 340/573 |
| 4,292,630 | 9/1981 | Dumont | 340/573 |
| 4,331,953 | 5/1982 | Blevins et al. | 340/539 |
| 4,418,337 | 11/1983 | Bader | 340/571 |
| 4,468,656 | 8/1984 | Clifford et al. | 340/539 |
| 4,524,243 | 6/1985 | Shapiro | 340/573 |
| 4,593,273 | 6/1986 | Narcisse | 340/539 |
| 4,598,272 | 7/1986 | Cox | 340/539 |
| 4,665,385 | 5/1987 | Henderson | 340/539 |
| 4,850,031 | 7/1989 | Allsop et al. | 455/49 |
| 4,906,972 | 3/1990 | Spencer | 340/539 |

*Primary Examiner*—Donnie L. Crosland

*Attorney, Agent, or Firm*—Bernard A. Reiter; James L. Jackson

[57] ABSTRACT

A personnel activity sensor and alarm system is provided which incorporates one or more remote personnel safety units each incorporating a multi-axis motion detector and reset timing and logic circuit coupled with a radio transmitter or transceiver. Under the command of the logic circuit, the radio automatically transmits an alarm signal and causes the circuitry to generate a local audio signal in the event of personnel inactivity for a predetermined period of time. This enables personnel assistance to be initiated without delay. A base station is also provided which incorporates a radio transceiver to which is coupled control logic circuitry for commanding transmission of radio integration and control signals to the radio receiver of the remote personnel units for acknowledgment of alert signal reception and for cancellation of the radio alarm signal to clear the radio channel for other activities. A computer and computer interface is also provided for computerized control of the entire system as well as for compiling data, monitoring personnel location, etc. This system is designed for use on conventional radio systems which may include relay of alarm signal through fixed or mobile repeaters and may be configured as part of a trunking radio radio system.

25 Claims, 4 Drawing Sheets

PERSONNEL MONITORING MAN-DOWN ALARM AND LOCATION SYSTEM

FIELD OF THE INVENTION

This invention relates generally to personnel activity monitoring systems and man-down alarm systems which are provided for worker protection when workers are involved in potentially hazardous activities. More specifically, this invention is directed to a fully integrated personnel monitoring, "man-down" alarm and location system incorporating portable radio transceivers each having a multi-axis motion sensor from which the safe or unsafe status of the individual user is determined. When an unsafe status is recognized, alarm signals are transmitted to a base radio transceiver to alert monitor personnel and acknowledgment signals are transmitted back to the alarming unit. Monitor personnel are then able to initiate timely rescue response procedures including dispatch and coordination of rescue personnel via radio communication.

BACKGROUND OF THE INVENTION

The present invention is particularly directed to users who, due to the nature of their situation, are often out of audio range of others. This may be because of distances involved or because of high audio frequency ambient noise generated by machinery or other sources. Some potential users of the present invention include refinery operations personnel, forest rangers, plant security personnel, police officers, facility maintenance personnel, etc. A personnel maintenance system of this nature may also be employed by users engaged in recreational activities such as hiking, hunting, or other circumstances where users may be out of contact with others for extended periods in remote conditions.

Personnel monitoring techniques are presently in use which make use of radio technology for basic safety purposes as a natural extension of the fundamental productivity purposes which the radio systems are installed to achieve. Some simple technology add-ons to basic portable radios are in common use to enhance basic safety capabilities of the radios. For instance, in cases of minor injury, the victim can call for assistance utilizing small radio transceivers or a panic button on the radio may be pushed to send out an emergency alarm signal.

The key problem is that, in cases of serious injury, when the user is immobilized and unable to initiate calls for help, the need for timely rescue is usually greatest. The lack of timely rescue can act to complicate the injury through increased loss of blood or shock or many other time related medical problems. Basic first aid principles are very clear in identifying the critical role time can play in serious injury situations and how minutes or even seconds saved in rescue time can mean the difference between the life or death of the victim.

A number of radio users who recognize this problem have developed timed reporting procedures to keep track of the safe status of personnel. This approach, which relies on users calling in their safe status, has a very serious weakness in its conflict between safety, user productivity, and monitoring logistics. In most situations it is not practical and perhaps impossible for a person to be reporting safe status and efficiently completing the assigned task. Moreover, even in cases of known high risk situations, it is often not practical to monitor the condition of workers at all times. Further, radio channels are limited and in many situations, the radio channels must be shared with others. As a result, most safe status reporting systems work on a reporting-in frequency ranging from every 10–20 minutes or longer. Obviously, there is a need to provide an efficient personnel monitoring and man-down alert system that is capable of immediately and reliably detecting a condition where a worker becomes incapacitated so that the worker may be located and attended to without delay. A less direct benefit of the present invention is the increased safety factor it provides to rescue personnel. When rescue personnel know that time is against them, they tend to rush their response, sometimes to the detriment of their own safety. The fast alarm reporting capability of the present invention can ease time pressure on rescue personnel and thereby increase their own safety without detriment to the personnel for whom the emergency is intended.

User motion is the key to reliable detection of unsafe user status. The lack of motion for a given period of time can be translated into a reliable means to detect an incapacitated person. From the standpoint of detection of motion, the critical factor is the need to be able to differentiate between motion and lack of motion. For example, under circumstances where a user of a motion detector system becomes incapacitated in the vicinity of large machinery, it is necessary that vibrations from the machinery are not misinterpreted as user motion. As a general rule, potential sources of interference will display a detectable pattern while user motion will tend to be random in nature. As such, filtering of interfering detectable input signals can be accomplished.

Another key consideration is that the motion detector must be capable of detecting motion and sensing the lack of motion in all physical planes. An incapacitated person, whether lying, sitting or standing must be capable of detection by absence of motion in that particular position. From the standpoint of reliable detection of incapacitated personnel, it must not be assumed that these personnel will end up flat out on the ground in a horizontal position. In accident situations involving electrical shock, toxic gasses, falls down stairs and numerous other situations, the victim may end up unconscious and/or immobilized in virtually any physical position including upside-down or even standing straight up wedged between pieces of machinery. Reliable detection of incapacitated personnel cannot be related to physical position of personnel. Further, the motion sensing system must render false alarms to an absolute minimum since false alarm signals reduce system integrity and place rescue personnel at unnecessary risk. Even further, the motion sensing system must insure that all lack of motion conditions of personnel be capable of rapid detection so that appropriate aid may be provided without delay in all conditions of personnel incapacitation.

SUMMARY OF THE INVENTION

It is a principle feature of this invention to provide a novel man-down personnel safety system which includes as its basic components, a motion detector section, a timing, alarm and radio control section, a radio interface, a radio section and an audio annunciator section, which together are carried by personnel in order to monitor their safe and/or unsafe status.

It is another feature of this invention that the remote device(s) carried by personnel provide a warning signal to the user when a period of time of no motion has been reached and that if no reaction to the warning is detected, that the device transmit radio and audio alarm signals in order to alert other personnel.

It is a further feature of this invention to provide a novel personnel safety system which incorporates a base monitoring station to monitor the output of one or more remote devices as carried by personnel and to be able to interpret alarm signals from those devices and provide warning signals and information to monitor personnel in order that rescue procedures may be initiated.

It is an even further feature of this invention that the base station be capable of controlling the alarm signaling of the remote safety device as to its radio alarm transmissions. In order for it to be possible for the remote devices to be capable of remote control from the base monitor, it is necessary that the radio section of the remote device include a radio receiver and that receiver be an integral and active component of the workings of the overall system.

It is another feature of this invention to provide a novel personnel alert safety system which provides user personnel with the capability of initiating a request for assistance even under circumstances where continuous motion of the user is sensed and the alarm system remains in the safe mode.

Briefly, the objects of the present invention are realized by the provision of a unique safety alarm system for use by individuals who may be working alone or working in a hazardous environment. The safety alarm system incorporates a remote unit which is basically the integrated combination of a multi-axis motion sensor and a radio transceiver or transmitter circuit which also incorporates reset, timer and control logic circuits together with other circuitry which enables the automatic transmission of an alert signal under circumstances where motion is not detected for a predetermined period of time. The personnel safety alert system further incorporates a base station or unit having transceiver circuitry for reception of alert signals from one or more remote personnel units that are attached to the body of the user to thus detect personnel incapacitation. The system is configured to permit interaction between the base unit and remote units in order to optimize the radio channel(s) for rescue and other emergency response communication which follows an alarm condition and to detect failure of unsafe user status signals reaching the base monitor. The radio system on which this interaction takes place may be a basic radio system of one operating channel, a system with repeaters and multiple channels or a trunking system with repeaters and multiple channels. The complexity of the radio system will determine how much system equipment interaction is required to accomplish the specific task of linking the base unit with the remote unit(s). Accordingly, discussion of radio systems herein is intended to encompass multi-channel and trunked radio systems as well.

To the base station transceiver is coupled an interface unit incorporating code generator, code decoder and control logic circuitry together with other circuitry that enables transmission and processing of alert signal codes and alarm signal codes. In normal usage, the personnel safety alert system monitors the user's movement. If the user is motionless for a predetermined period of time, such as 20 seconds for example, the remote personnel unit will emit a low-level audio pulsating pre-alarm tone to warn the user that the remote unit is about to transmit an alert signal which will be received by the base station transceiver. The pre-alarm tone can be stopped and the timing cycle reset to zero by a gentle movement of the motion sensor radio transmitter or transceiver. If the user is motionless for another predetermined period of time, i.e., for a total of 30 seconds (10 seconds beyond onset of the pre-alarm tone) the remote personnel unit will generate transmission of a coded radio signal to the base station transceiver, then listen briefly for a response signal from the base and then transmit an audio alarm signal and then repeat this pattern until an acknowledgment signal from the base answers back that it recognizes the user requires assistance at which point the remote unit will switch to an audio alarm only transmission. The audio alert signal of the remote personnel unit is an extremely loud and distinctive multi-pitch audio tone which allows searchers to pinpoint the exact location of the remote personnel unit and the user to which it is attached.

The alarm tones are sent in a pseudo-random time sequence which allows the base unit to quickly detect alert signals from multiple remote personnel units. The radio transmits the alarm code, then listens for an acknowledgment radio signal and then the audio alarm is sounded. The interface unit of the base station is preferably coupled with a computer system having specific software for the personnel alert safety system and also incorporating a CRT monitor and keyboard. When the computer receives the alarm code, it automatically causes the transmitter of the base station to send a confirming "cancel" radio message back to the remote personnel unit. This "cancel" message informs the remote unit to discontinue the radio portion of the alert, thereby clearing the radio channel. At the same time the alarm tone switches to a continuous rather than alternating sequence, thereby informing personnel near the remote unit that the computer has properly received the alarm message and is in the process of initiating personnel assistance activities.

The remote unit will typically consist of two major assemblies, i.e., (1) am assembly containing the multi-axis motion detector together with appropriate circuitry for reset timing, control logic audio alarm generation and code signal generation and (2), a radio transmitter or transceiver which will typically take the form of a small battery powered, hand-held radio transceiver or transmitter unit. The hand-held transceiver or transmitter contains the normal transmit and receive circuitry as the case may be which is necessary for typical radio receiver or two way radio operation as the case may be. In fact, where appropriate, the remote personnel alert unit may be coupled very simply by means of an interface cable with the radio circuitry of radio transmitters and transceivers already owned by customers.

The base unit or base station incorporates a radio transceiver and interface unit in a computer. The interface unit is utilized as a translator between the format of the remote personnel unit and the format of the proprietary computer software. The interface unit is physically connected between the base station transceiver and the computer. The computer, through one of its communication ports receives and transmits data to the interface unit. The interface units receives and sends data to the base station transceiver on three lines: Push - To - Talk and transmit audio lines to the transceiver and a receive audio line from the receiver.

The remote personnel unit may be appropriately configured in several different modes as suits the needs of the user. It may be configured for transmission only through the use of a conventional radio transmitter or it may be configured for both transmission and receiving through the use of a radio transceiver.

The personnel safety system becomes automatically activated when the remote user is immobilized or rendered unconscious or when manually activated by the user. The system is specifically designed to send its alarm in a manner which will minimize interference on shared radio channels and the timing of alarm transmissions is varied to permit a number of units to render alarm signals on a radio channel at the same time. Further enhancements are described which provide rescue personnel with vital information relating to victim location and means to format the alarm system to provide maximum safety related information with minimum disruption of a user's work routine.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the Drawings

FIG. 1 is a block diagram electrical schematic depicting the electrical circuitry for a remote personnel safety unit constructed in accordance with the present invention.

FIG. 2 is a block diagram electrical schematic illustrating the circuitry for a base unit constructed in accordance with the present invention.

FIG 3 is a block diagram electrical schematic illustrating a remote personnel unit incorporating a radio transmitter.

FIG. 4 is a block diagram electrical schematic illustrating a remote personnel safety unit having both transmit and receive capability-by a radio transceiver fully integrated therein.

FIG. 5 is a block diagram electrical schematic illustrating a remote personnel safety unit of fully integrated nature having a radio transceiver for two-way transmission and incorporating a radio alarm.

FIG. 6 is a block diagram electrical schematic illustrating a remote personnel safety unit which is coupled to a customer's portable radio bY means of a multi-conductor shielded cable.

FIG. 7 is a block diagram electrical schematic illustrating a remote personnel safety unit of the nature set forth in FIG. 6 and including an audio alarm.

DETAILED DESCRIPTION OF PREFERRED EMBODIMENT

While the preferred embodiment is described at the system level, as being part of a conventional radio system of one or more channels, this safety system will also work as as part of a trunked radio system. All that is necessary is to ensure that the operating protocol of the trunked system is incorporated in the alarm signaling format of the remote and base units. Further, a trunked radio system may provide the option to assign normal base station capabilities such as alarm receipt and acknowledgment to system devices such as the trunking repeater. In this configuration, the repeater could receive and acknowledge an alarm signal from a remote unit and then pass the alarm signal on to the monitor base station at the first available opportunity. Additional system level channel management features common on radio trunking systems, such as automatic assignment of potential rescue personnel to a common channel upon receipt of a person down alarm are also anticipated.

Figure 1:
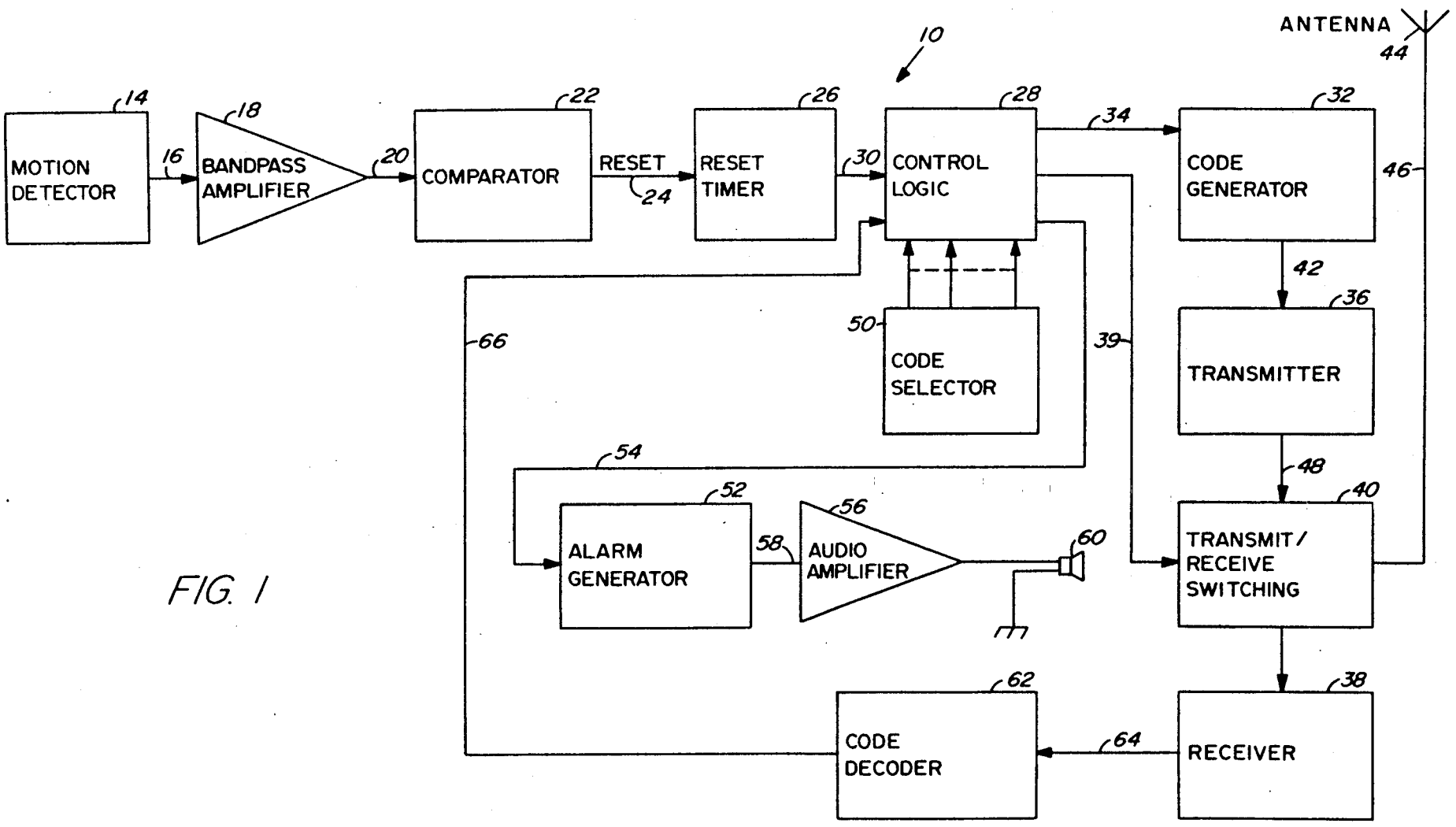
Figure 2:
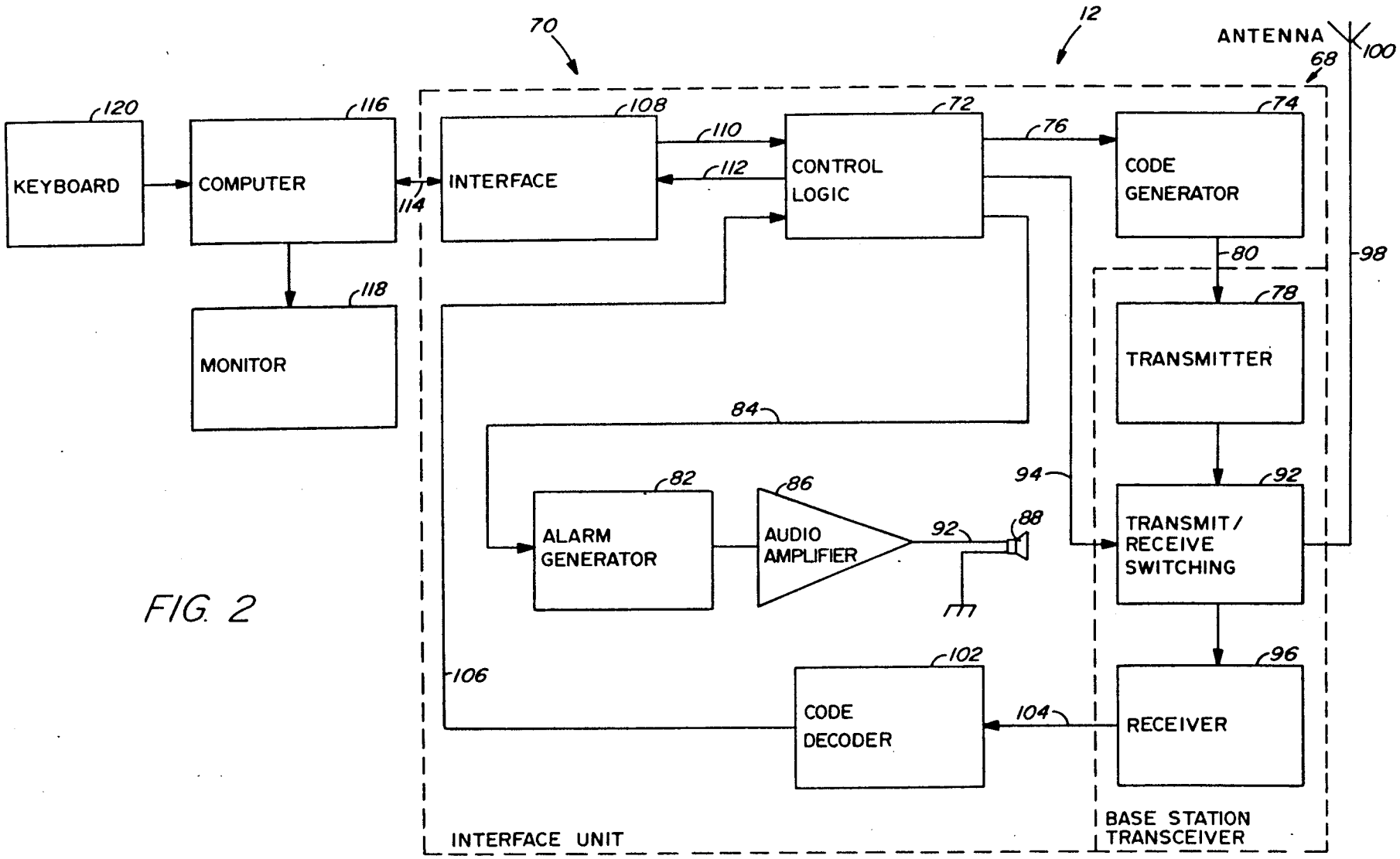

Referring now to the drawings and first to FIGS. 1 and 2, a personnel alert safety system constructed in accordance with the present invention is illustrated which incorporates a remote personnel alert system illustrated generally at 10 and shown in FIG. 1 and a base unit or base station illustrated generally at 12 in FIG. 2. With reference particularly to FIG. 1, the remote personnel alert system will incorporate a three-axis motion detector 14 which is an electromechanical device capable of sensing motion in any of the three axes and producing a voltage proportional to the amount of movement. Although the motion detector 14 may take any one of a number of suitable forms, for purposes of discussion, it may incorporate a block or blocks, typically composed of metal, arranged so as to define a spherical cavity at or near its center. A spherical ball rolls freely in the spherical cavity and produces vibration that occurs as the position of the motion detector is changed, such as when a worker to which the motion detector is attached moves about while in the process of carrying out assigned activities. A sensitive microphone is attached to one end of the block and is capable of sensing the vibration of the rolling ball. The output voltage from the motion detector is transmitted via conductor 16 to a bandpass amplifier 18 which amplifies a specific range of frequencies while sharply rejecting all other frequencies. The exact range of frequencies amplified is carefully coordinated with the design of the three axis motion detector so as to amplify only those frequencies produced by movement of the detector while rejecting all others (such as might be produced by other acoustic sources impinging on the detector). The voltage output of the amplifier is therefore proportional to the motion of the detector and is transmitted by conductor 20 to a comparator circuit 22. The comparator circuit measures the peak level of the bandpass amplifier output and supplies a "reset" command by conductor 24 to a reset timer circuit 26. The reset timer monitors the time interval between reset commands supplied by the comparator circuit. If the time exceeds the "warning time interval", the reset timer causes the control logic 28 to which it is coupled by conductor 30 to generate a "warning" signal to the operator. If the time exceeds the "alert time interval", the reset timer will cause the control logic to initiate and "alert" sequence. In practice, the reset timer circuitry may be integrated into the control logic circuitry. The control logic circuit 28 contains, typically, a microprocessor with custom software which, in response to various inputs, generates various output signals to control the various modes of the remote personnel alert unit; however, these differ in the detailed software programs. In simple alarm formats the control logic circuit could consist of a suitable multi-tone encoder with a unique code programmed for each individual remote personnel unit and ready to be transmitted when an alarm condition is reached. In more complex systems the fundamental unit identification may be enhanced by storage of the user location/status information which could be done, for one example, by the user encoding the information via a DTMF keypad. This information could form part of the alarm transmission or could be sent as the user entered it or could be stored until the radio channel is clear and ready to receive such information.

In addition to the storage of alarm information for transmission, the control logic circuit stores signal recognition information for recognition of alarm acknowledgment and control signals received from monitor stations or rescue personnel radios. For instance, the device could be configured to transmit an ANI signal with each voice transmission with the time between receipt of the ANI measured by the base monitor. If no activity was noted by the base for a selected period of time such as 5 or 10 or twenty minutes, the base could call the remote unit for confirmation of the unit's working status. This would provide a fail safe feature in that if a remote unit was damaged in a severe user accident, and was unable to report the man down incident, the base monitor would recognize a problem when it got no answer to its transpond signal. The transponding rate of the monitor station can be fixed or user selectable according to the perceived risk situation of the users. As with the alarm transmission signals, the specific circuits of this segment may be in any suitable multi-tone or other format. The difference is that while the alarm transmission will be accomplished by signal encoders, the alarmed acknowledgment and control will be accomplished by signal decoders.

The control logic circuit can also be utilized for storage of user entered voice information such as location/status which would be stored in digital format and converted to audio for transmission with an alarm transmission or at other times as users may need the information. The key advantage to this segment of the circuit is that it provides users with the abilities to store vital alarm information without waiting to access the radio channel and provides clear voice alarm information directly to potential rescue personnel without the need for a central alarm monitor to interpret the alarm data.

A code generator circuit 32 is provided which receives commands via conductor 34 from the control logic circuit 28 and which in response thereto, generates an "alert" tone sequence to be transmitted over the radio transmitter or transceiver. In practice, the remote personnel alert circuitry uses the industry-standard DTMF (i.e., "Touch Tone") signaling standard for code generation and decoding, however, the remote unit would theoretically work with any analog or digital signaling standard.

The remote personnel unit may be fully integrated with a radio transceiver or transmitter essentially as shown in FIG. 1 or it may be coupled to a portable radio transmitter or transceiver within the scope of this invention when a radio transceiver is provided. As shown in FIG. 1, transmitter and receiver circuits 36 and 38 are provided which are coupled by transmit/receive switching 40. The transmit/receive switching circuit places the transceiver in either the receive or transmit mode under command of the control logic circuit 28 which is coupled thereto by conductor 39. If desired the transmit/receive switching circuit 40 may be integrated as a component part of the control logic circuitry. In response to the alert tone sequence via conductor 42 the transmitter circuit will send its transmitted signal to the antennae 44 by means of the antenna circuit 46 by way of the switching circuit 40 and transmitter circuit 48. The normal antenna that is used with the hand-held transceiver (typically a rubber coated flex antenna) is utilized to intercept the radiated radio signal and supplies the resultant voltage to the receiver for subsequent processing. When transmitting, the antenna radiates the radio signal from the transmitter circuit. This radio signal is coded by the code generator circuit 36.

A code selector circuit 50 is coupled with control logic circuit 28 and may conveniently take the form of a bank of switches, jumper wires or read only memory (ROM) which select the "alert" and "cancel alert" codes for the particular transceiver in use.

An alarm generator circuit 52 is coupled by conductor 54 with control logic circuit 28 and is provided to generate a signal to produce the local audio tone. The alarm generator circuit may also be incorporated as a component part of the control logic circuitry. An audio amplifier 56 receives at its input the local audio tone by coupling conductor 58 and accomplishes amplification of the level of the output of the alarm generator 52 to that necessary to drive an audio transducer 60 which is coupled with the output of the audio amplifier. The audio transducer converts the output of the audio amplifier to a loud audible alarm signal which will aid rescue workers to pinpoint the exact location of the worker in need of rescue.

The receiver circuit 38 of the radio transceiver receives the signal from the base station transceiver in the system. The receiver maY be part of any conventional hand-held transceiver as long as it is compatible with the mating transmitter at the base station.

A code decoder circuit 62 is provided having its input coupled by conductor 64 to the output of the receiver circuit 38. The code decoder decodes the signal from the receiver and inputs data to the control logic circuit 28. In practice, the remote personnel alert unit utilizes the industry-standard DTMF (i.e., "Touch Tone") signaling standard for code generation and decoding. However, the remote unit will theoretically work with any analog or digital signaling standard. If a valid code is decoded, the microprocessor, under control of its proprietary software, will perform the appropriate system activity (e.g., canceling a radio alarm).

Referring now to FIG. 2, the circuitry of the base station is illustrated generally at 12 in block diagram form. The base station circuit 12 will typically be of integrated form incorporating base station transceiver circuitry shown generally at 68 and an interface unit illustrated generally at 70. The interface unit 70 incorporates a control logic circuit 72 which contains typically a microprocessor with custom software which, in response to various inputs, generates appropriate output signals to control the various modes of the remote personnel units. Similar circuits are used in both the remote personnel units and the base station unit, however, these differ in the detailed software program.

A code generator circuit 74 is coupled with the control logic circuit 72 by conductor 76 and is provided to generate the control tone sequences to be transmitted by the radio transmitter or transceiver when commanded by the control logic circuit 72 thereby conveying system commands and information to the individual remote transceivers. In practice, the remote personnel unit uses the industry-standard DTMF (i.e., "Touch Tone") signaling standard for code generation and decoding, however, the remote personnel unit would theoretically work with any analog or digital signaling standard.

A transmitter circuit 78 of the base station transceiver 78 is coupled by conductor 80 with the code generator circuit 74 and is provided to generate the radio signal for communicating with the hand-held transceivers in the system. The transmitter circuit 78 may be a part of any conventional base station transceiver as long as it is compatible with the mating receiver in the hand-held transceiver.

An alarm generator circuit 72 has its input coupled by conductor 84 to an appropriate output of the control logic circuit 72. The alarm generator is provided to generate a signal producing the local audio tone. The alarm generator may be integrated as a component part of the control logic circuitry 72. The output of the alarm generator is amplified by an audio amplifier circuit 86 which amplifies the level of the output of the alarm generator to that necessary to drive an audio transducer 88 to which it is coupled by conductor 90. The output of the audio amplifier is converted by the audio transducer to a loud audio alarm signal which will inform the dispatcher that an alert signal has occurred.

A transmit/receive switching circuit 92 is controlled by command signals from the control logic circuit 72 transmitted by conductor 94 to place the transceiver switching circuit either in a transmit or receive switching mode for selective coupling of the transmitter circuit 78 or a receiver circuit 96 to an antenna circuit 98 having an antenna 100. The receiver circuit receives the signal or signals from remote personnel units in the system and may be part of any conventional base station transceiver as long as it is compatible with the mating transmitter in the hand-held transmitter of the remote personnel unit. The normal antenna utilized with the base station transceiver, when receiving, intercepts the radiated radio signal and supplies the resultant voltage to the receiver for subsequent receiving. When transmitting, the antenna radiates the signal from the transmitter circuit 78 thereby emanating a radio signal that is received by the antenna 44 and receiver 38 of the remote personnel unit.

A code decoder circuit 102 is coupled via conductor 104 with the output of the receiver circuit 96. The circuit 102 decodes the signal from the receiver circuit and inputs data to the control logic circuit 72 by way of conductor 106. In practice, the code decoder circuit 102 utilizes the industry-standard DTMF (i.e., "Touch Tone") signaling standard for code generation and decoding, however, the system would theoretically work with any analog or digital signaling standard. If a valid code is decoded, the microprocessor, under control of its proprietary software, will perform the appropriate system activity, (e.g., canceling a radio alarm).

It is considered practical and preferable to incorporate a computer in conjunction with this radio controlled personnel monitoring system. The interface unit 12 may typically be classified as an interface between the base station transceiver 68 and a computer having appropriate proprietary software for controlling the operation of the personnel alert safety system. Computer interface circuitry is shown at 108 which is coupled by "To" and "From" command circuits 110 and 112 to the control logic circuit 72. The interface circuitry 108 is also coupled by a circuit 114 to the appropriate port of a computer 116 having a CRT monitor 118 and a keyboard 120. The keyboard enables the system operator to input commands and information into the computer 116. The interface circuitry 108 comprises a bi-directional translator which connects between the computer 116 and the controlled logic 72 and translates the levels of signals passing between the computer and control logic to the respective correct levels. The CRT monitor provides for viewing information generated by the computer. While the personnel monitoring system of this invention will find many applications at the basic service level, it is in more complex operations where the full capability of this system will have considerable importance. With a large number of users sharing a limited number of channels and equipped with safety and voice communication capability according to this invention, it becomes cost effective to utilize computer technology at the monitor base stations. The computer is interfaced to a base transmitter/receiver or in some instances, a portable transceiver, with a signal translation device which converts the signal format of this invention to a format which the computer can receive and process. A computer will be capable of high speed processing of alarm information, interaction with the remote personnel devices and numerous other functions such as maintaining a log of personnel locations, etc. The computer can also perform such functions as timed status monitoring to supplement the basic personnel safety alarm. In this operation, if voice and alarm communications share the same user identification, the computer could monitor voice communications and interrogate any remote personnel device for serviceability after a programmed period if not hearing from the user on voice communication. This would help insure that if the remote personnel safety equipment becomes damaged for any reason, this situation can be detected by the alarm device failing to answer the base interrogation.

The remote personnel safety system of this invention comprises as the more important of its aspects, the combination of a motion detector and a portable radio system that is capable of transmitting an alarm system to a base radio station in the event specific criteria is met. The remote units are capable of recognizing when their radio alarm signals have been received by the monitor site. The motion detector circuitry incorporates reset timer circuitry and control logic circuitry which provide appropriate commands to a code generator and transmitter for transmitting a radio alert signal and an audio alarm generator and amplifier for user reset of the device at the warning signal should user status be safe or for transmission of loud audio alarm signals which will warn others in the immediate vicinity or assist rescue personnel in locating the victim in a timely fashion. The safety system of this invention also incorporates a base station radio transceiver and interface unit which may be coupled with a computer to provide for computer control of all aspects of the personnel alert safety system including the provision of radio interrogation and commands for the remote personnel unit to insure personnel alerting if the person is not incapacitated and for causing the remote personnel unit to transmit an alarm under circumstances where a sufficient length of personnel inactivity indicates personnel incapacitation requiring immediate assistance.

The personnel safety system of this invention is uniquely spectrum-efficient as it does not require a dedicated or duplex radio channel. The system may be added to existing user radio systems and provide reliable alarm reporting without taking up more than an absolute minimum amount of radio channel time. With this system it is recognized that under emergency circumstances, users may have higher priorities of response tasks than immediate rescue of one person and may require the maximum capabilities of the radio system. This system also uniquely provides staggered alert timing to accommodate multiple alerts without endless collision of the signals, jamming the radio system. This system is also specifically configured to avoid false inputs due to other date activity on its shared channel, specifically, from other DTMF ("Touch Tone") traffic on the radio channel.

Figure 3:
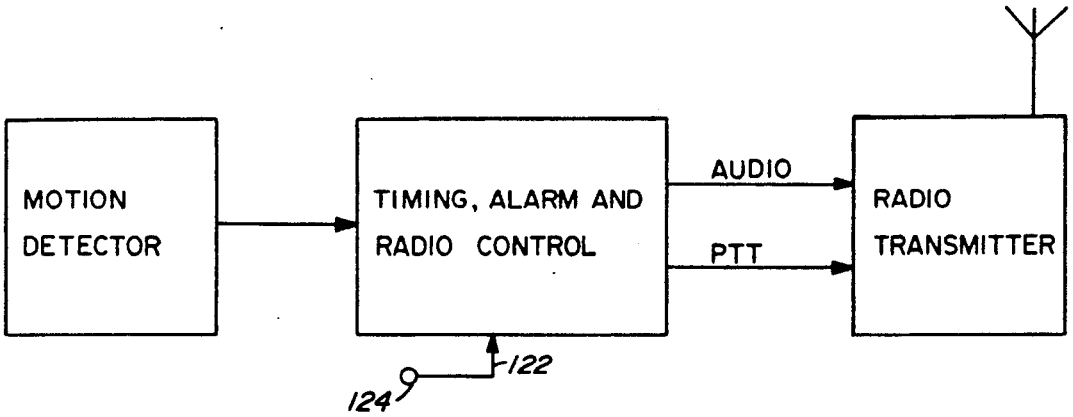
Figure 4:
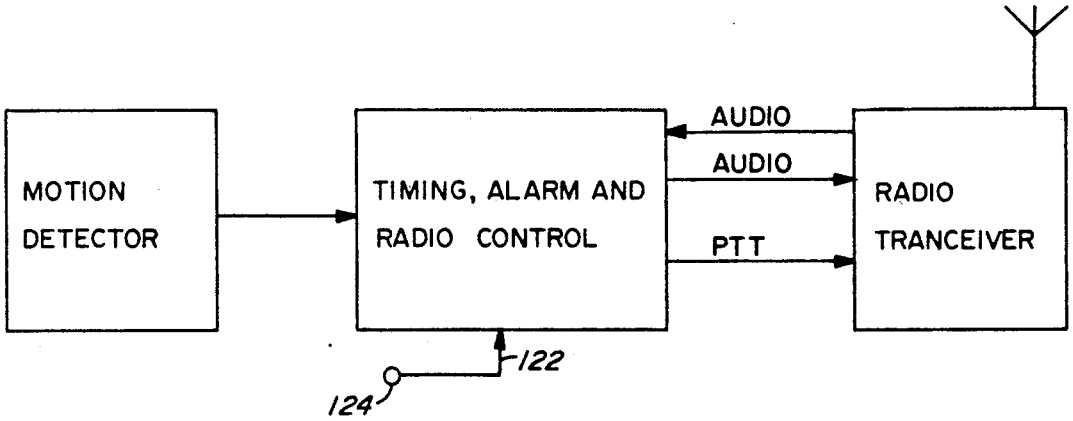

As shown in block diagram form in FIGS. 3-7, the personnel alert safety system of this invention may take any number of suitable forms without departing from the spirit and scope of this invention. As shown in FIG. 3, the remote personnel unit incorporates a motion detector which transmits motion related voltage to timing alarm and radio control circuitry as explained above in connection with FIG. 1. This circuitry includes a panic circuit 122 having a switch that is controlled by a panic button 124 that may be manipulated by the worker to provide a worker controlled signal. This signal may indicate that assistance is needed or may provide the base station with identification of the location of the worker. The circuit 122 may also incorporate a keypad, enabling the worker to transmit data to the base station for updating the computer with such information such as the worker's identification, location, etc. The circuitry of FIG. 3 incorporates a fully integrated radio transmitter circuit. The circuitry illustrated in FIG. 4 differs from that of FIG. 3 in that the fully integrated radio is a transceiver rather than a transmitter, thereby providing for two-way radio transmission between the remote personnel unit and the base station.

Figure 5:
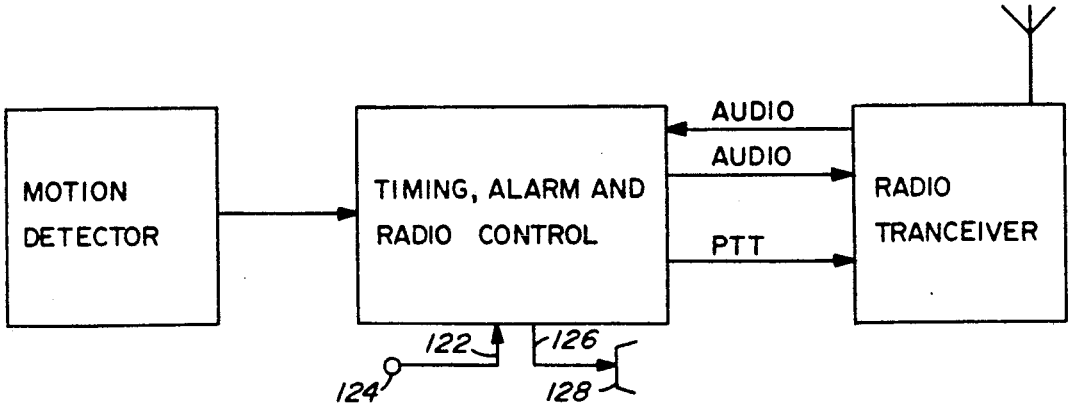

The circuitry of FIG. 5, in addition to the features illustrated in FIG. 3, incorporates an audio circuit 126 having a high level audio transducer 128 for local generation of audio alert and alarm signals.

Figure 6:
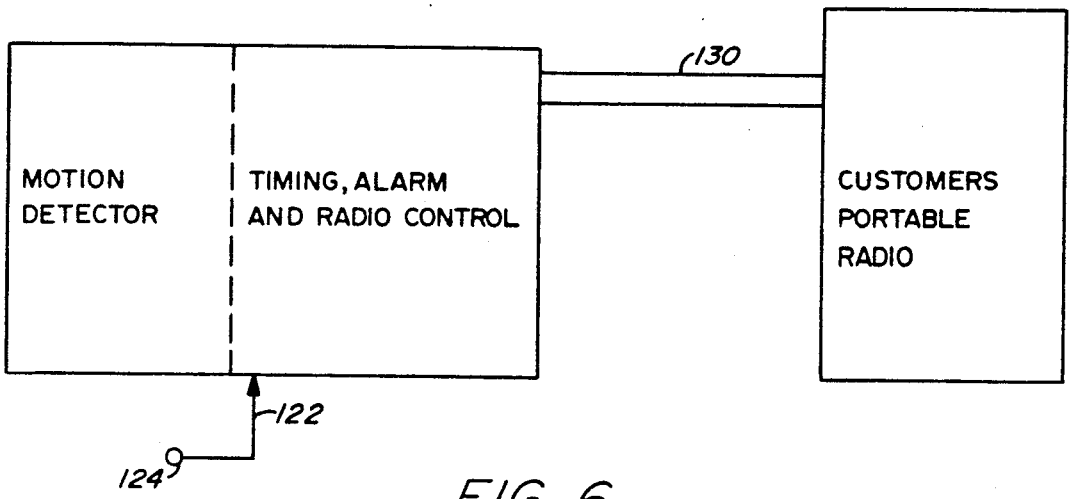

The configuration of the personnel alert safety system of FIG. 6 illustrates the compatibility of a motion detector and timing alarm and radio control system with a customer's portable radio or with a radio selected by the customer. In this case, a shielded cable 130 is employed to provide the portable two-way radio with the capability of transmitting motion related signals to be received at a base station such as that shown at 12 in FIG. 2.

Figure 7:
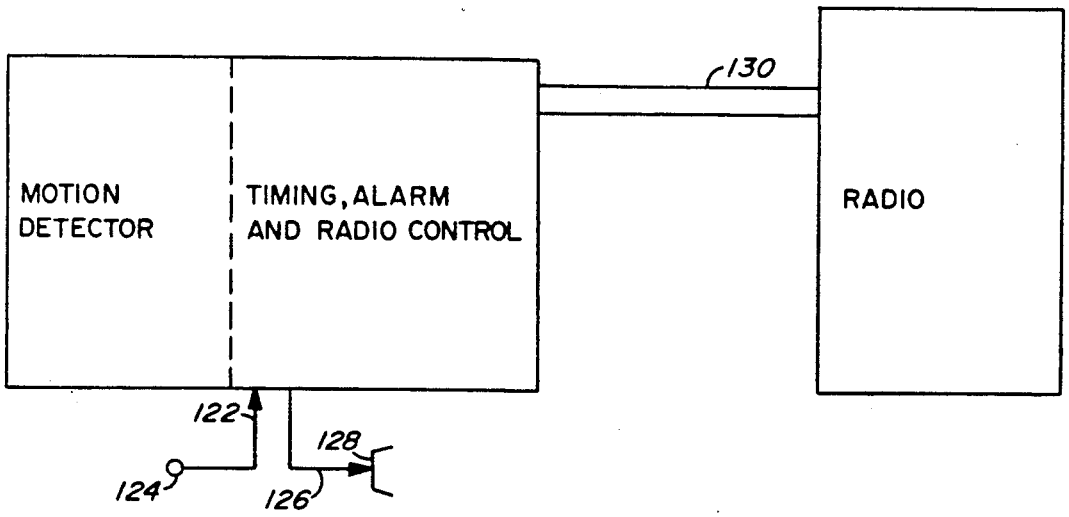

As shown in FIG. 7, the system depicted includes an audio circuit 126 coupled with a high-level audio transducer 128 of the nature shown in FIG. 5.

It is thus evident that the basic "building blocks" of the personnel alert safety system of this invention include a motion detector section, a timing alarm and radio control section, a radio interface, a radio section and optional audio annunciator section. The personnel alert safety system may be composed of one single unit made up of the above building blocks or may be made up of several individual components which are interfaced together by cable or by other means to provide the performance of an integrated unit. The key reason for the multi-device approach is that, while a fully integrated unit will provide inherently higher reliability, the multi-device approach can make the use of a customer's existing radio equipment and can provide the system with significant flexibility to thereby permit the customer to design a system in accordance with its specific requirements.

The alarm signaling method may be any method, audio or digital, which will work at the system level. The prime consideration will be the nature of the radio system and the ability of any signal format to pass through any necessary retransmission and still be successfully interpreted at any monitor station. The user identification aspect of the alarm message may be fixed to the particular personnel alert safety system unit or may be programmable by the user for the user's own identification. Digital voice storage may also be utilized for user identification.

If the remote personnel unit is configured as a radio transmitter only, there will be a need for multiple alarm transmission to insure alarm receipt. This signal may be repeated on an off/on basis to permit other similar alarms to be received by monitor stations. Alarm transmission may also be optimized for maximum operating time in relation to available power sources. This would be very important in applications where immediate receipt of the alarm is not expected.

If the personnel alert safety unit is configured with a radio transceiver, there is the opportunity for alarm acknowledgment signaling from monitor stations.

In general, the personnel alert safety system of this invention is a fully integrated "man-down" alarm and personnel locating system intended for use by workers employed in hazardous locations, where, due to equipment failure, life-threatening gas leaks or radiation may suddenly occur rendering the worker unconscious and in need of immediate assistance. This system is uniquely configured to operate on a shared simplex or half-duplex radio channel thereby insuring efficient spectrum utilization. When not used by this system, the channel may be used for normal radio communications. The system is adaptable to large numbers of workers.

When the circuitry of a worker's radio senses lack of motion for a preset period of time, the radio emits a warning tone to notify the worker of an impending alert. If the worker does not cancel the alert within a preset time interval, the radio emits: (a) a radio alarm signal encoded with the unique number of that radio and (b) a loud local audio tone to enable rescue personnel to quickly pinpoint the exact location of the worker. The worker's radio also includes a "panic button" which immediately initiates a system alert in the event the panic button is keyed by the worker. A keypad attached to the worker's radio enables a worker to input personnel locating information. The worker may input either the location to which the worker is moving or the location at which the worker has arrived.

The base station equipment consists of a radio transmitter/receiver, and interface unit and a computer/monitor/keyboard unit. The computer is loaded with proprietary software which controls the entire system.

The computer allows data entry of typical information, for example: worker information, assignment of radios to workers, assignment of active radios, assignment of locations within the operating complex, etc. Should an alert occur, the computer will display the name and location of the worker needing assistance.

In view of the foregoing, it is readily apparent that the present invention is capable of efficiently accomplishing all of the objects and features of the present invention together with other features that are inherent in the personnel alert safety system discussed herein.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A personnel activity sensor and alarm system adapted to be worn by user personnel, comprising:

(a) a housing adapted to be attached to the user personnel and having therein motion sensor means being operative in any plane and capable of detecting motion of said housing and providing an electrical output signal reflecting any motion detected thereby;

(b) reset timer and control logic circuitry being located in said housing and being disposed to receive said electrical output signal of said motion sensor means and developing an electrical alert command signal responsive to the absence of detected motion of said housing for a predetermined period of time; and (c) a portable radio transmitter being coupled in interactive relation with said reset timer and control logic circuitry and upon receiving said electrical alert command signal providing a radio alarm signal output indicating an emergency in response to said electrical alert command signal, whereby said radio alert signal output is transmitted only when said reset timer and control logic circuitry reaches an alarm condition.

2. The personnel activity sensor and alarm system of claim 1, including:

audio alarm means being coupled with said control logic circuitry for generation of local alert and alarm tones responsive to said electrical alert command signal.

3. The personnel activity sensor and alarm system of claim 2, wherein said audio alarm means comprises:

(a) an audio alarm generator being coupled for command with said control logic circuitry for generation of a local audio tone;

(b) an audio amplifier receiving and amplifying said local audio tone; and (c) an audio transducer being connected in driven relation with said audio amplifier for generation of local audio tones as commanded by said control logic circuitry.

4. The personnel activity sensor and alarm system of claim 1, wherein:

said portable radio transmitter is a transceiver having transmit/receive switching coupled for transmit/-receive command with said control logic circuitry.

5. The personnel activity sensor and alarm system of claim 4, including:

a code generator being coupled for command with said control logic circuitry and being coupled with said portable radio transmitter, said code generator generating an alert tone sequence for transmission by said portable radio transmitter.

6. The personnel activity sensor and alarm system of claim 4, wherein:

the receiver of said transceiver is coupled in radio signal data input relation with said control logic circuitry.

7. The personnel activity sensor and alarm system of claim 6, including:

a code decoder circuit being coupled to the output of said receiver and with a data input of said control logic circuitry, said decoder circuit decoding the signal from said receiver and inputting the decoder signal to said control logic circuitry.

8. The personnel activity sensor and alarm system of claim 1, including:

(a) a bandpass amplifier being coupled in signal receiving relation with said motion sensor means and being adapted to amplify a specific range of frequencies while rejecting other frequencies;

(b) a comparator circuit being coupled with the output of said bandpass amplifier and measuring the peak level of the bandpass amplifier output, said comparator circuit supplying reset commands responsive to predetermined peak level output of said bandpass amplifier; and (c) a reset timer circuit being coupled with said comparator circuit and with a data input of said control logic circuitry, said reset timer circuit monitoring the time interval between reset commands.

9. The personnel activity sensor and alarm system of claim 1, including:

base station circuitry having a base radio transceiver including a base transmitter and receiver, transmit/receive switching and an antenna for receiving alarm signals from said portable radio transmitter, said base station incorporating alarm signal processing circuitry for selectively inducing said transmitter of said base station to transmit a control tone sequence to said receiver.

10. The personnel activity sensor and alarm system of claim 9, wherein said base station circuitry includes:

(a) base control logic circuitry being coupled in command relation with said base transmitter and with said transmit/receive switching and is operative to generate output signals for controlling the modes of said base station and remote units; and (b) said base receiver receiving radio signals from said transmitter and being coupled in data input relation with said base control logic circuitry for inducing said control logic circuitry to selectively generate command signals according to said data input.

11. The personnel activity sensor and alarm system of claim 10, wherein said base station circuitry further includes:

a computer being coupled in data receiving and operation controlling relation with said base control logic circuitry, said computer having operational software for controlling operation of said personnel alert safety system.

12. The personnel activity sensor and alarm system of claim 1, including:

base station circuitry having a base radio transceiver including a base transmitter and receiver, transmit/receive switching and an antenna for receiving alarm signals from said portable radio transmitter, said base station incorporating alarm signal processing circuitry for selectively inducing said transmitter of said base station to transmit control tone sequence to said receiver.

13. A personnel activity sensor and alarm system comprising:

(a) at least one remote personnel unit comprising:
(1) motion sensor means being operative in any plane and capable of detecting motion and providing an output signal reflecting any motion detected thereby;
(2) control circuitry receiving said output signal of said motion sensor means and developing an alert command signal responsive to the absence of detected motion for a predetermined period of time; and
(3) a portable radio transceiver being coupled in interactive relation with said control circuitry and providing a radio alert signal output in response to said alert command signal; and
(b) a base station comprising:
(1) a base station transceiver for receiving radio signals from and transmitting radio signals to each of said remote personnel units, said base station transceiver incorporating transmit/-receive switching circuitry for the transmitter and receiver circuits thereof;
(2) control circuitry being coupled in command relation with said base station transmitter circuit and with said transmit/receive switching circuit and being coupled in signal data input relation with said base station receiver circuit, said control circuitry inducing said base station transmitter circuit to transmit command signals to said control circuitry of said remote personnel units;
(3) a computer interface circuit being coupled with said control circuitry; and
(4) a computer being coupled with said computer interface circuitry and being disposed in controlling relation with said control circuitry.

14. The personnel activity sensor and alarm system of claim 13, including:
audio alarm means being coupled with said control logic circuitry for generation of local alert and alarm tones responsive thereto.

15. The personnel activity sensor and alarm system of claim 14, wherein said audio alarm means comprises:
(a) an alarm generator being coupled for command with said control logic circuitry for generation of a local audio tone;
(b) an audio amplifier receiving and amplifying said local audio tone; and
(c) an audio transducer being connected in driven relation with said audio amplifier for generation of audio tones as commanded by said control logic circuitry.

16. The personnel activity sensor and alarm system of claim 13, wherein:
said portable radio transmitter is a transceiver having transmit/receive switching coupled for transmit/-receive command with said control logic circuitry.

17. The personnel activity sensor and alarm system of claim 16, including:
a code generator being coupled for command with said control logic circuitry and being coupled with said portable radio transmitter, said code generator generating an alert tone sequence for transmission by said portable radio transmitter.

18. The personnel activity sensor and alarm system of claim 16, wherein:
(a) the receiver of said transceiver is coupled in radio signal data input relation with said control logic circuitry; and
(b) a code decoder circuit being coupled to the output of said receiver and with a data input of said control logic circuitry, said decoder circuit decoding the signal from said receiver and inputs the decoder signal to said control logic circuitry.

19. A personnel activity sensor and alarm system adapted to be worn by user personnel, comprising:
(a) at least one remote personnel unit comprising:
(1) a housing adapted to be attached to the user personnel and having therein motion sensor means being operative in any plane and capable of detecting motion of said housing and providing an electrical output signal reflecting any motion detected thereby;
(2) reset timer and control logic circuitry being located in said housing and being disposed to receive said electrical output signal of said motion sensor means and developing an electrical alert command signal responsive to the absence of detected motion of said housing for a predetermined period of time; and
(3) a portable radio transmitter being coupled in interactive relation with said reset timer and control logic circuitry and upon receiving said electrical alert command signal providing a radio alarm signal output indicating an emergency. in response to said electrical alert command signal, whereby said radio alert signal output is transmitted only when said reset timer and control logic circuitry reaches an alarm condition; and
(b) a base station comprising:
(1) a base station transceiver for receiving radio signals from and transmitting radio signals to each of said remote personnel units, said base station transceiver incorporating transmit/-receive switching circuitry for the transmitter and receiver circuits thereof; and
(2) control circuitry being coupled in command relation with said base station transmitter circuit and with said transmit/receive switching circuit and being coupled in signal data input relation with said base station receiver circuit, said control circuitry inducing said base station transmitter circuit to transmit command signals to said control circuitry of said remote personnel units.

20. The personnel activity sensor and alarm system of claim 19, including:
(a) a computer interface circuit being coupled with said control circuitry; and
(b) a computer being coupled with said computer interface circuitry and being disposed in controlling relation with said control circuitry.

21. The personnel activity sensor and alarm system of claim 20, including:
audio alarm means being coupled with said control logic circuitry for generation of local alert and alarm tones responsive thereto.

22. The personnel activity sensor and alarm system of claim 20, wherein said audio alarm means comprises:
(a) an alarm generator being coupled for command with said control logic circuitry for generation of a local audio tone;
(b) an audio amplifier receiving and amplifying said local audio tone; and
(c) an audio transducer being connected in driven relation with said audio amplifier for generation of audio tones as commanded by said control logic circuitry.

23. The personnel activity sensor and alarm system of claim 20, wherein:

said portable radio transmitter is a transceiver having transmit/receive switching coupled for transmit/-receive command with said control logic circuitry.

24. The personnel activity sensor and alarm system of claim 20, including:

a code generator being coupled for command with said control logic circuitry and being coupled with said portable radio transmitter, said code generator generating an alert tone sequence for transmission by said portable radio transmitter.

25. The personnel activity sensor and alarm system of claim 20, wherein:

(a) the receiver of said transceiver is coupled in radio signal data input relation with said control logic circuitry; and (b) a code decoder circuit being coupled to the output of said receiver and with a data input of said control logic circuitry, said decoder circuit decoding the signal from said receiver and inputs the decoder signal to said control logic circuitry.

* * * * *